US007815521B2

(12) United States Patent
Ban et al.

(10) Patent No.: US 7,815,521 B2
(45) Date of Patent: Oct. 19, 2010

(54) GOLF CLUB HEAD

(75) Inventors: Wataru Ban, Chichibu (JP); Vinh-Duy Thai Nguyen, Lake Forest, CA (US)

(73) Assignee: Bridgestone Sports, Co., Ltd., Tokyo (JP)

( * ) Notice: Subject to any disclaimer, the term of this patent is extended or adjusted under 35 U.S.C. 154(b) by 76 days.

(21) Appl. No.: 11/565,868

(22) Filed: Dec. 1, 2006

(65) Prior Publication Data

US 2008/0132351 A1 Jun. 5, 2008

(51) Int. Cl.
*A63B 53/04* (2006.01)

(52) U.S. Cl. ..... 473/330; 473/342

(58) Field of Classification Search ..... 473/324–350
See application file for complete search history.

(56) References Cited

U.S. PATENT DOCUMENTS 1,289,553 A 12/1918 Sanders
1,337,958 A 4/1920 Reach
1,965,954 A 7/1934 Davis
2,005,401 A 6/1935 Storz et al.
D190,035 S 4/1961 Hansen, Jr.
3,693,978 A * 9/1972 East ..... 473/314
4,067,572 A 1/1978 Coleman
4,413,825 A 11/1983 Sasse
4,753,440 A 6/1988 Chorne
4,858,929 A 8/1989 Long
4,957,294 A 9/1990 Long
5,029,864 A 7/1991 Keener
5,100,144 A 3/1992 Okumoto et al.
5,437,088 A 8/1995 Igarashi
5,591,092 A 1/1997 Gilbert
5,637,044 A 6/1997 Swash
5,688,186 A 11/1997 Michaels et al.
5,709,616 A 1/1998 Rife
5,744,780 A * 4/1998 Chang et al. ..... 219/121.73
5,766,087 A 6/1998 Kawamatsu
5,766,097 A 6/1998 Horiuchi et al.
5,785,610 A 7/1998 Birmingham
5,788,584 A * 8/1998 Parente et al. ..... 473/290
6,733,400 B2 * 5/2004 Sherwood ..... 473/290
6,814,673 B2 11/2004 Wahl et al.
6,849,004 B2 2/2005 Lindsay (Continued)

FOREIGN PATENT DOCUMENTS

JP 02-026574 A 1/1990

(Continued)

*Primary Examiner*—Alvin A Hunter
(74) *Attorney, Agent, or Firm*—Paul, Hastings, Janofsky & Walker LLP

(57) ABSTRACT

The present invention provides a golf club head comprising, a face, a plurality of score line grooves formed in the face, traces formed in the face by milling; and a pair of side surfaces of the score line groove including a first surface that is contiguous with the face and a second surface that is contiguous with the first surface in the depth direction of the score line groove. A first angle that is formed by each first surface of the pair of side surfaces is larger than a second angle that is formed by each second surface of the pair of surfaces. The face in which the traces are formed has the arithmetic mean deviation of the profile (Ra) of not less than 4.00 μm.

3 Claims, 15 Drawing Sheets

U.S. PATENT DOCUMENTS

| | | | | |
|---|---|---|---|---|
| 6,981,923 | B2 | 1/2006 | Chappell | |
| 7,014,568 | B2 * | 3/2006 | Pelz | 473/287 |
| 7,056,226 | B2 | 6/2006 | Kennedy | |
| 7,066,833 | B2 | 6/2006 | Yamamoto | |
| 7,156,751 | B2 | 1/2007 | Wahl et al. | |
| 7,159,292 | B2 | 1/2007 | Suzuki et al. | |
| 7,166,039 | B2 * | 1/2007 | Hettinger et al. | 473/331 |
| 7,179,175 | B2 * | 2/2007 | Kennedy, III | 473/330 |
| 7,192,361 | B2 | 3/2007 | Gilbert et al. | |
| 7,258,627 | B2 | 8/2007 | Chappell | |
| 7,275,999 | B2 | 10/2007 | Sherwood | |
| 7,285,057 | B2 | 10/2007 | Mann et al. | |
| 7,327,017 | B2 | 2/2008 | Sirinorakul et al. | |
| 2002/0016218 | A1 | 2/2002 | Takeda | |
| 2002/0042306 | A1 | 4/2002 | Chappell et al. | |
| 2002/0132683 | A1 | 9/2002 | Buchanan | |
| 2003/0008724 | A1 | 1/2003 | Griffin | |
| 2004/0087387 | A1 | 5/2004 | Wahl et al. | |
| 2005/0037859 | A1 | 2/2005 | Gilbert et al. | |
| 2005/0075191 | A1 | 4/2005 | Bennett | |
| 2005/0085312 | A1 | 4/2005 | Nagai et al. | |
| 2005/0130761 | A1 | 6/2005 | Vokey et al. | |
| 2005/0143187 | A1 | 6/2005 | Kennedy | |
| 2006/0003851 | A1 | 1/2006 | Chappell et al. | |
| 2006/0154739 | A1 | 7/2006 | Mann, Jr. et al. | |
| 2006/0223648 | A1 * | 10/2006 | Kennedy, III | 473/330 |
| 2007/0010346 | A1 | 1/2007 | Gilbert et al. | |
| 2007/0149312 | A1 | 6/2007 | Gilbert | |
| 2008/0020859 | A1 | 1/2008 | Yamagishi et al. | |
| 2008/0032814 | A1 | 2/2008 | Ban | |
| 2008/0051212 | A1 | 2/2008 | Vogues et al. | |
| 2008/0102981 | A1 | 5/2008 | Nguyen et al. | |
| 2008/0108453 | A1 | 5/2008 | Park et al. | |
| 2008/0125242 | A1 * | 5/2008 | Ban | 473/331 |
| 2008/0125243 | A1 | 5/2008 | Ban | |
| 2008/0132351 | A1 | 6/2008 | Ban et al. | |
| 2008/0132352 | A1 | 6/2008 | Ban | |
| 2008/0167138 | A1 | 7/2008 | Ban et al. | |
| 2008/0242442 | A1 | 10/2008 | Gilbert et al. | |
| 2009/0011852 | A1 | 1/2009 | Solheim et al. | |
| 2009/0029797 | A1 | 1/2009 | Ban et al. | |
| 2009/0036228 | A1 | 2/2009 | Ban et al. | |
| 2009/0082129 | A1 | 3/2009 | Ban et al. | |

FOREIGN PATENT DOCUMENTS

| | | | |
|---|---|---|---|
| JP | 08-000777 | A | 1/1996 |
| JP | 08-229169 | A | 9/1996 |
| JP | 09-308715 | A | 2/1997 |
| JP | 09-070457 | A | 3/1997 |
| JP | 09-192274 | A | 7/1997 |
| JP | 09-253250 | A | 9/1997 |
| JP | 09-308714 | A | 12/1997 |
| JP | 10-015116 | A | 1/1998 |
| JP | 10-179824 | A | 7/1998 |
| JP | 10248974 | A | 9/1998 |
| JP | 2001178856 | A | 7/2001 |
| JP | 2002126135 | A | 5/2002 |
| JP | 2002-224250 | A | 8/2002 |
| JP | 2002-291949 | A | 10/2002 |
| JP | 2003-093560 | A | 4/2003 |
| JP | 2005-169129 | A | 6/2005 |
| JP | 2005-287534 | A | 10/2005 |
| JP | 2007-202633 | A | 8/2007 |
| JP | 2008005994 | A | 1/2008 |
| JP | 2008079969 | A | 4/2008 |
| JP | 2001-170227 | A | 8/2009 |
| WO | 00/02627 | A1 | 1/2000 |
| WO | 00/74799 | A1 | 12/2000 |
| WO | 01/97924 | A1 | 12/2001 |
| WO | 03045507 | A | 6/2003 |

* cited by examiner

FIG. 10

| | SCORELINE GROOVE SPECIFICATIONS | | | | | | | | | | FINDINGS | | |
|---|---|---|---|---|---|---|---|---|---|---|---|---|---|
| | CROSS SECTION SHAPE | ANGLE θ1 (°) | ANGLE θ2 (°) | ROUNDING RADIUS (mm) | WIDTH W (mm) | RULE-BASED WIDTH Wr (mm) | DEPTH D (mm) | PITCH (mm) | CROSS SECTION AREA S ($mm^2$) | CROSS SECTION AREA RATIO (%) | DEGREE OF SCRATCHES | AMOUNT OF SPIN (rpm) | |
| | | | | | | | | | | | | DRY | WET |
| #1 | SINGLE SIDE SURFACE (TRAPEZOIDAL) | 15 | – | 0 | 0.90 | 0.90 | 0.50 | 3.60 | 0.417 | 93 | 10 | 9610 | 7130 |
| #2 | | 30 | | | | | | | 0.383 | 85 | 8 | 9830 | 4500 |
| #3 | | 60 | | | | | | | 0.306 | 68 | 5 | 9960 | 2800 |
| #4 | SINGLE SIDE SURFACE (V-SHAPED) | 90 | | | | | 0.45 | | 0.203 | 45 | 3 | 10050 | 1580 |
| #5 | | 120 | | | | | 0.26 | | 0.117 | 26 | 1 | 9950 | 1170 |
| #11 | TWO-STEP SIDE SURFACE (WITH BOTTOM SURFACE) | 30 | 15 | 0 | 0.90 | 0.90 | 0.50 | 3.60 | 0.392 | 87 | 9 | 9850 | 4600 |
| #12 | | 60 | 22 | | | | | | 0.356 | 79 | 6 | 9980 | 4100 |
| #13 | | 90 | 35 | | | | | | 0.274 | 61 | 4 | 10070 | 2500 |
| #14 | | | 22 | | | | | | 0.331 | 74 | 5 | 10020 | 3500 |
| #15 | TWO-STEP SIDE SURFACE (WITHOUT BOTTOM SURFACE) | 120 | 68 | | | | | | 0.181 | 40 | 2 | 9960 | 1500 |
| #16 | TWO-STEP SIDE SURFACE (WITH BOTTOM SURFACE) | | 35 | | | | | | 0.180 | | 2 | 9970 | 1450 |
| #17 | | | 15 | | | | | | 0.254 | 56 | 3 | 9980 | 2000 |
| #18 | TWO-STEP SIDE SURFACE (WITH BOTTOM SURFACE) | 30 | 15 | 0.2 | 0.90 | 0.707 | 0.45 | 2.83 | 0.284 | 80 | 4 | 9600 | 7000 |
| #19 | | 33 | | | 1.10 | 0.900 | | 3.60 | 0.370 | 82 | 5 | 9774 | 6100 |

FIG. 12

| | STRIATION SPECIFICATIONS | | FINDINGS | |
|---|---|---|---|---|
| | | | AMOUNT OF SPIN (rpm) | |
| | θO (°) | Ra (μm) | NORMAL | OPEN |
| #21 | 67 | 4.4 | 6600 | 7200 |
| #22 | 45 | | 6500 | 7300 |
| #31 | 90 | 0.5 | 3000 | 3500 |
| #32 | | 2.0 | 3300 | 3900 |
| #33 | | 3.0 | 4000 | 4500 |
| #34 | | 4.0 | 5700 | 6200 |
| #35 | | 4.4 | 6450 | 6900 |
| #36 | 23 | | 6000 | 7000 |
| #37 | 0 | | 5600 | 6600 |

FIG. 14A

| | SCORELINE GROOVE SPECIFICATIONS | | | | | | | | | | MILLING | Ra (μm) |
|---|---|---|---|---|---|---|---|---|---|---|---|---|
| | CROSS SECTION SHAPE | ANGLE θ1 (°) | ANGLE θ2 (°) | ROUNDING RADIUS (mm) | WIDTH W (mm) | RULE-BASED WIDTH Wr (mm) | DEPTH D (mm) | PITCH (mm) | CROSS SECTION AREA S ($mm^2$) | CROSS SECTION AREA RATIO (%) | | |
| COMPARATIVE EXAMPLE 1 | SINGLE SIDE SURFACE (TRAPEZOIDAL) | 15 | – | 0 | 0.90 | 0.90 | 0.50 | 3.60 | 0.417 | 93 | ABSENCE | 0.4 |
| COMPARATIVE EXAMPLE 2 | | | | | | | | | | | PRESENCE | 4.4 |
| COMPARATIVE EXAMPLE 3 | TWO-STEP SIDE SURFACE (WITH BOTTOM SURFACE) | 33 | 15 | 0.2 | 1.10 | 0.90 | 0.50 | 3.60 | 0.346 | 77 | ABSENCE | 0.4 |
| EXAMPLE | | | | | | | | | | | PRESENCE | 4.4 |

FIG. 14B

| | FINDINGS | | |
|---|---|---|---|
| | DEGREE OF SCRATCHES | AMOUNT OF SPIN (rpm) | |
| | | FAIRWAY | ROUGH |
| COMPARATIVE EXAMPLE 1 | △ | 9610 | 7130 |
| COMPARATIVE EXAMPLE 2 | × | 9300 | 7800 |
| COMPARATIVE EXAMPLE 3 | ◎ | 9780 | 6100 |
| EXAMPLE | ○ | 9300 | 8200 |

GOLF CLUB HEAD

BACKGROUND OF THE INVENTION

1. Field of the Invention

The invention relates to a golf club head.

2. Description of the Related Art

The face of a golf club head include a plurality of grooves, known as marking lines, score lines, or face line grooves (hereinafter referred to as score line grooves), which affect the amount of spin on a ball. It is desirable to have the grooves on an iron club head, especially a wedge, in order to increase the amount of spin on the ball.

Japanese Patent Application Laid-Open No. 9-192274 discloses a golf club having grooves of V-shaped or trapezoidal cross section. Japanese Patent Application Laid-Open No. 9-70457 and No. 10-179824 disclose a golf club head with rounding on the edges of the score line groove, that is, where the score line grooves meets the face. The rounding has the effect of avoiding scratching or other damage to the ball. Japanese Patent Laid-Open No. 2003-93560 and No. 2005-287534 disclose a golf club head having score line grooves each of which has a side surface with two varying angles, such that the side surface is not constituted on a single, flat plane. Rules of golf regulate width and depth of score line grooves on a golf club head used in official competition play, and steps must be taken that satisfy the pertinent rules when considering applications in official play.

The amount of spin on the ball affects the surface roughness of the face as well. Japanese Patent Laid-Open No. 2005-169129 discloses a golf club head with a face having the surface roughness of not less than 40 Ra. Japanese Patent No. 3,000,921 discloses a golf club head with a face having a plurality of fine grooves that are distinct from the score line grooves. Rules of golf regulate roughness of a face on a golf club head used in official competition play, and steps must be taken that satisfy the pertinent rules when considering applications in official play.

Spin on a ball tends to decline when hitting in bad weather or in the rough, compared with hitting in fair weather or on the fairway. Increasing the volume of the score line grooves is one method of avoiding reduction in spin when hitting in bad weather or in the rough. Increasing the volume of the score line grooves makes it easier to get rid of grass and dirt that may be caught between the face and the ball into the score line grooves, and also improves drainage performance on the face.

Score line grooves with square cross-sectioning tends to have larger volume than score line grooves with other cross-sectioning, presuming an identical width, at the cost of increased damage to the ball, owing to a sharper angle on the edges of the score line groove.

Score line grooves with a V-shaped or trapezoidal cross-section may minimize damage to the ball, at the expense of reduced score line grooves volume, which tends to significantly reduce spin when hitting in bad weather or in the rough.

The golf club head disclosed in Japanese Patent Laid-Open No. 2003-93560 has score line groove edges with sharp angles that cause greater damage to the ball. The golf club head disclosed in Japanese Patent Laid-Open No. 2005-287534 may be unworkable, owing to the width of the interior of the score line groove being wider than the score line groove in the face. The score line groove edges also have sharp angles that cause greater damage to the ball. While Japanese Patent Laid-Open No. 2005-287534 discloses a golf club head with rounding on the edges of the score line groove, score line groove edges with significantly sharp angles, such as the score line grooves in Japanese Patent Laid-Open 2005-287534, may cause greater damage to the ball even if the edges are rounded. Even if the surface roughness of the face is modified, such as with the golf club heads disclosed in Japanese Patent Laid-Open No. 2005-169129 and Japanese Patent No. 3,000,921, poor drainage performance on the face will reduce spin.

SUMMARY OF THE INVENTION

The present invention has been made in order to overcome the deficits of prior art.

According to an aspect of the present invention, it is provided a golf club head comprising a face, a plurality of score line grooves formed in the face, traces formed in the face by milling, and a pair of side surfaces of the score line groove including a first surface that is contiguous with the face and a second surface that is contiguous with the first surface in the depth direction of the score line groove, wherein a first angle that is formed by each first surface of the pair of side surfaces is larger than a second angle that is formed by each second surface of the pair of surfaces, and wherein the face in which the traces are formed has the arithmetic mean deviation of the profile (Ra) of not less than 4.00 μm.

The golf club head is formed such that the first angle, which is formed by the first side, is larger than the second angle, which is formed by the second side surfaces. The first side surfaces of the score line grooves contribute to avoiding damage to the ball, and the second side surfaces contribute to ensuring volume in the score line grooves. Therefore, the golf club head can avoid significant declines in spin when hitting in bad weather or in the rough, as well as damage to the ball.

The arithmetic mean deviation of the profile (Ra) of not less than 4.00 μm in the face allows significantly greater spin through improved friction between the ball and the face.

Further features of the present invention will become apparent from the following description of exemplary embodiments (with reference to the attached drawings).

BRIEF DESCRIPTION OF THE DRAWINGS

FIG. 10 depicts the findings of an experiment that measured ball damage and spin for golf club heads No. 1 to No. 5, and golf club heads No. 11 to No. 19, each with different score line groove specifications.

FIG. 12 depicts the findings of an experiment that measured ball damage and spin for golf club heads No. 21 No. 22, and golf club heads No. 31 to No. 37, each with different score line groove specifications.

FIG. 14A depicts specifications of an example of the present invention and comparative examples 1 to 3.

FIG. 14B depicts the findings of an experiment of the example of the present invention and comparative examples 1 to 3.

DESCRIPTION OF THE EMBODIMENTS

Figure 1:
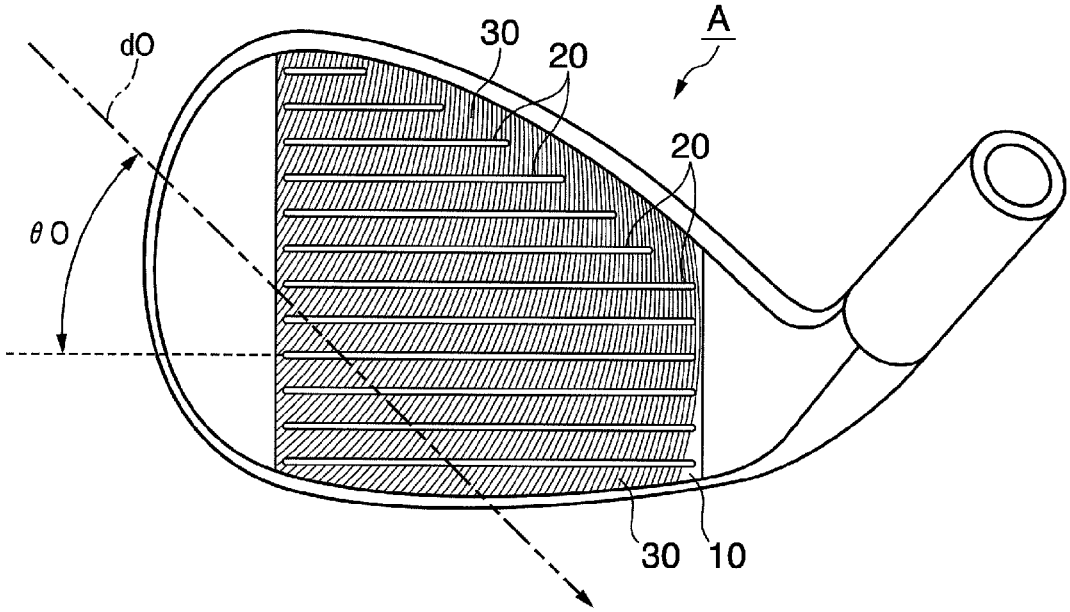
FIG. 1. is an external view of a golf club head A, according to an embodiment of the present invention.

FIG. 1 is an external view of a golf club head A, according to an embodiment of the present invention. The embodiment depicted in FIG. 1 applies the present invention to an iron club head. The present invention is optimized for club heads for which large amounts of spin are required, especially wedges such as sand wedges, pitching wedges, or approach wedges. The present invention may also be applied to golf club head for the wood type or the utility type.

The face 10 of the golf club head A comprises a plurality of the score line grooves 20. The face 10 is the surface that strikes the golf ball. According to the embodiment, the respective score line grooves 20 are arrayed in straight lines in the toe-heel direction, all in parallel, with equal pitch between the respective score line grooves 20. The face 10 comprises a plurality of striations 30, which are traces formed by milling.

<Score Line Grooves 20>

Figure 2:
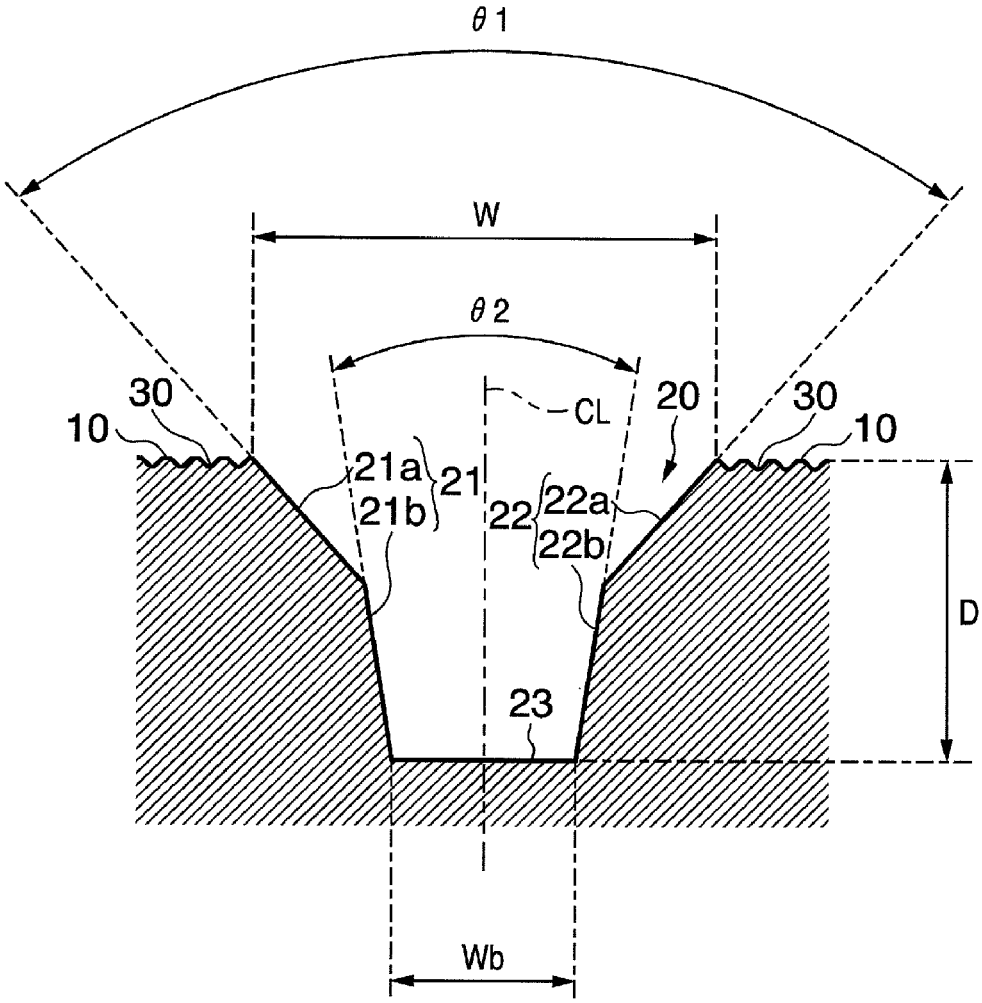
FIG. 2 is a cross-sectional diagram in the vicinity of a score line grooves 20, which cuts at right angles to the lengthwise, or toe-heel direction, of the score line grooves.

FIG. 2 is a cross-sectional diagram in the vicinity of a score line grooves 20, which cuts at right angles to the lengthwise, or toe-heel direction, of the score line grooves. In the embodiment, the cross-section of each score line groove 20 is constant in the lengthwise direction, except at the ends. The cross-sections are constant for each score line grooves 20.

The score line groove 20 has a pair of side surfaces 21 and 22 and a bottom surface 23. In the embodiment, the cross-section of the score line grooves 20 is symmetrical with respect to a center line CL. The pair of side surfaces 21 and 22 of the score line grooves 20 respectively comprises a first surface 21*a* and 22*a*, which are contiguous with the face, and a second surface 21*b* and 22*b*, in the direction of the depth of the score line groove 20, and which are contiguous with the first surface 21*a* and 22*a*. The bottom surface 23 is parallel to the face 10, and also contiguous with the second surface 21*b* and 22*b*.

The score line groove 20 has a bottom surface width Wb, a depth D, and a width W. The bottom surface width Wb refers to the distance between the ends of the bottom surface 23. The depth D refers to the distance from the face 10 to the bottom surface 23. The width W is the width of the score line grooves 20 intersecting at right angles to the lengthwise direction thereof, and refers to the distance between the edges of the score line grooves 20, that is, the distance between the boundary between the first surface 21*a* and the face 10, and the boundary between the first surface 22*a* and the face 10. When rounding the edges of the score line grooves 20 by a radius r, as depicted in FIG. 3A, the width W will be measured from the point where the rounding begins, that is, the position of the dotted line in FIG. 3A.

The rounding of the edges has the effect of preventing damage to the ball, and rounding of a radius r of between 0.05 mm and 0.3 mm is preferable. In terms of spin on the ball, it is further preferable that the radius r be between 0.05 mm and 1 mm, inclusive.

The term "width of score line groove" used herein means the width W, as measured via the foregoing method, and is differentiated as the width measured via so-called the 30 degrees measurement rule in the R&A regulation which is a method for measuring groove width of a golf club head used for official games. As shown in FIG. 3C, the 30 degrees measurement rule refers to measuring the distance between points on a hypothetical line L, with a 30-degree inclination vis-à-vis the face 10, and that connect the side surfaces 21 and 22, as a width Wr. The width measured by the 30 degrees measurement rule will be referred to hereinafter as the rule-based width.

Figure 3A:
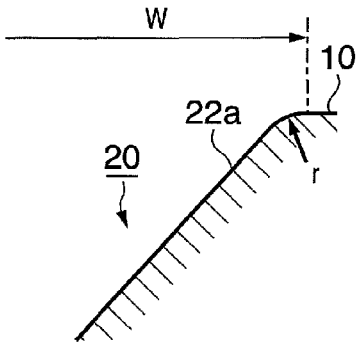
FIG. 3A describes a rounding of the edge of the score line grooves 20.

When rounding is applied to the edges of the score line grooves 20, as depicted in FIG. 3A, the width W of the score line groove 20 W may differ from the rule-based width Wr. When rounding is not applied to the edges of the score line groove 20, the width W will equal the rule-based width Wr. The rule-based width Wr is mandated as being not greater than 0.9 mm. The rules also mandate that the score line grooves depth D is not more than 0.5 mm.

Returning to FIG. 2, an angle θ1, which is formed by the first surface 21*a* and 22*a* of the score line groove 20, is larger than an angle θ2, which is formed by the second surface 21*b* and 22*b* of the score line groove 20. The bigger the angle θ1 gets, the bigger the angle of the edges of the score line groove 20, i.e., the boundary between the first surface 21*a* and 22*a* and the face 10, gets, and the more damage to the ball is avoided. In other words, the first surface 21*a* and 22*a* of the score line grooves 20 contribute to avoiding damage to the ball.

The fact that the angle θ2 is smaller than the angle θ1 contributes to enlarging the volume of the score line grooves 20. In greater detail, composing the side surfaces 21 and 22 of the score line grooves 20 of the first surfaces 21*a* and 22*a* and the second surfaces 21*b* and 22*b* which have different angles, allows making the bottom segment of the score line grooves 20 wider than when the score line grooves 20 is composed solely of the first surface 21*a* and 22*a*. It is thus possible to enlarge the volume of the score line grooves 20. Therefore, portions of the score line groove 20 may share the function, i.e. the second surfaces 21*b* and 22*b* of the score line grooves 20 contribute to ensuring the volume of the score line groove.

In such a manner, the golf club head 1 is capable of avoiding a significant decline in spin when hitting the ball in bad weather or in the rough, as well as minimizing damage to the ball.

The larger the cross section area of the score line groove 20 gets, the larger the volume of the score line groove 20 gets. The size of the cross section area of the score line groove 20, or to put it another way, a cross section area ratio, is suggested as an indicator that evaluates the volume of the score line groove 20 hereinafter, according to the embodiment. Again, rules for golf club heads used in competition call for the depth D to be not greater than 0.5 mm. Accordingly, when the edges of the score line grooves 20 are not rounded, the maximum cross section area of the score line grooves 20, when the rule-based width Wr applies, is Wr (mm)×0.5 mm=0.5×Wr ($mm^2$), as depicted on the right-hand side of FIG. 3B.

Figure 3B:
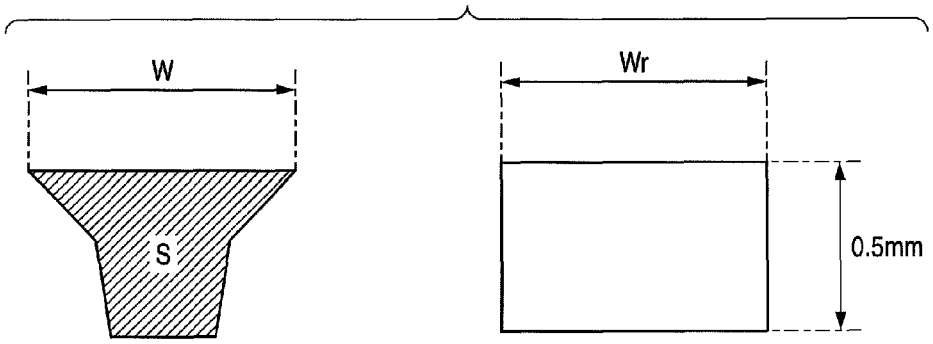
FIG. 3B is a schematic diagram illustrative of a cross section area ratio.
Figure 3C:
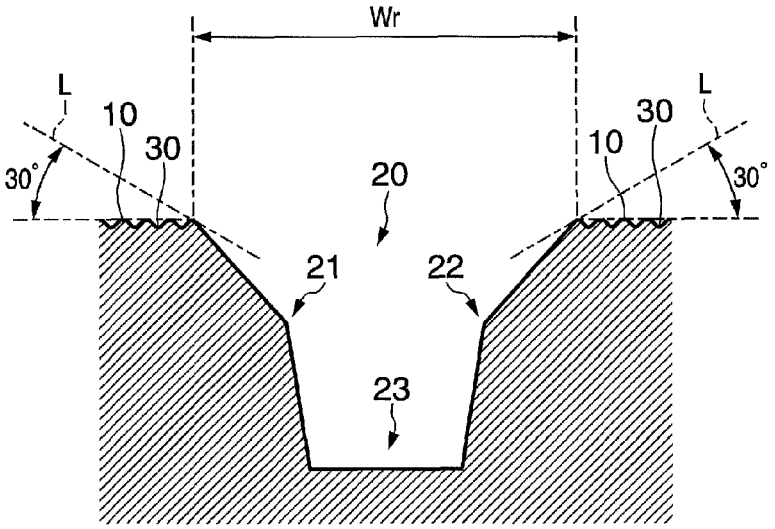
FIG. 3C is a schematic diagram illustrative of the 30 degrees measurement rule.

The cross section area ratio of the score line groove 20 for the cross section area S ($mm^2$) as per the left-hand side of FIG. 3B, vis-à-vis the maximum cross section area, is an indicator that evaluates the volume of the score line groove 20. The cross section area ratio is displayed in equation (1). It is desirable for the cross section area ratio to be not less than 70%, as will be described hereinafter.

$$\text{Cross Section Area Ratio (\%)}=S/(Wr\times 0.5)\times 100 \qquad \text{Equation (1)}$$

<Example of Score Line Grooves Cross Section Shape>

Figure 4A:
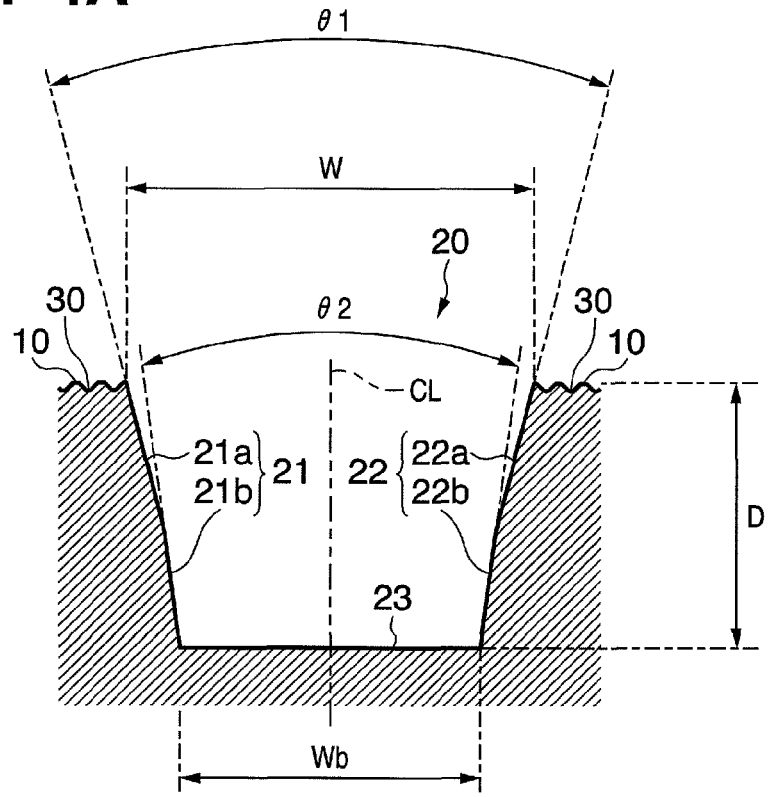
FIG. 4A and FIG. 4B are cross-sectional diagrams depicting examples of score line grooves.

FIG. 4A depicts a smaller angle θ1 than the example shown in FIG. 2. As depicted in the example in FIG. 4A, the smaller the angle θ1 gets, the bigger the cross section area of the score line grooves 20 gets, and thus, the bigger the volume of the score line grooves 20 gets. The smaller the angle θ1 gets, however, the smaller the angle of the edge of the score line groove 20 gets, and thus, the more likely the ball is to be damaged. It is thus preferable to add rounding to the edges of the score line grooves 20 in this situation.

It is preferable to add rounding to the edges of the score line grooves 20 when the angle θ1 is 50 degrees or less, and it is preferable to have the radius r of the rounding of the edges of the score line groove 20 be between 0.05 mm and 0.3 mm, inclusive, and to keep the radius r between 0.05 mm and 0.1 mm, inclusive. If the angle θ1 is excessively small, however, the ball may be damaged even if the edges of the score line grooves 20 are rounded. Accordingly, it is preferable that the angle θ1 be not smaller than 10 degrees.

Figure 4B:
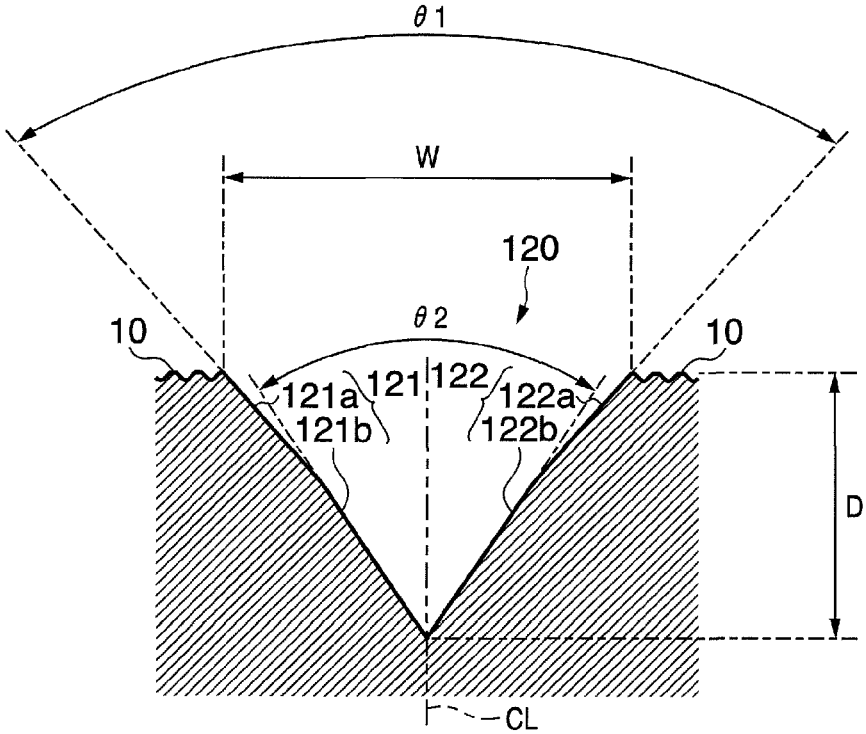

Whereas the score line grooves 20, as depicted in FIG. 2, has the bottom surface 23, it is also possible to have the score line grooves 20 have no bottom surface 23. Having the bottom surface will make it easier to enlarge the cross section area of the score line grooves, however. FIG. 4B is a cross-sectional diagram of a score line groove 120 with no bottom surface. The score line groove 120 has a configuration similar to that of the score line grooves 20, being formed from a pair of side surfaces 121 and 122, and excepting the fact that the score line grooves 120 has no bottom surface. The score line grooves 120 cross-section is symmetric with regard to the central line CL, according to the embodiment. A pair of side surfaces 121 and 122 of the score line groove 120 are composed of a first surface 121*a* and 122*a*, which are contiguous with the face 10, and a second surface 121*b* and 122*b*, which are contiguous with the first surface 121*a* and 122*a* in the depth direction of the score line groove 120. The angle θ1 that is formed by the first surface 121*a* and 122*a* of the score line groove 120 is larger than the angle θ2 that is formed by the second surface 121*b* and 122*b*.

<Striation 30>

With reference to FIGS. 1 and 2, each striation 30 is of a significantly small form according to the embodiment, being smaller in cross section area than the score line groove 20. In the embodiment, each striation 30 forms a circular arc, and is shaped so as not to overlap any other striation 30. Also in the embodiment, each striation 30 is an arc of radius identical to every other striation 30. Whereas a plurality of the striations 30, formed by milling, were adopted as the traces in the face 10 in the embodiment, the shape of the trace is not limited thereto, and a variety of shapes may be so adopted.

An arrow d0 in FIG. 1 depicts an arrangement direction of the plurality of striations 30. In the embodiment, each striation 30 is an arc of radius identical to every other striation 30 as described above. The arrangement direction d0 is defined as the direction that passes through the center of the circle of arc of each striation 30. An angle θ0, which is formed by the arrangement direction d0 and the lengthwise direction of the score line groove 20, is between 40 and 70 degrees, inclusive, as measured clockwise from the toe side end of the score line groove 20. With regard to the striations 30 depicted in FIG. 1, the angle θ0 is approximately 45 degrees.

Figure 5:
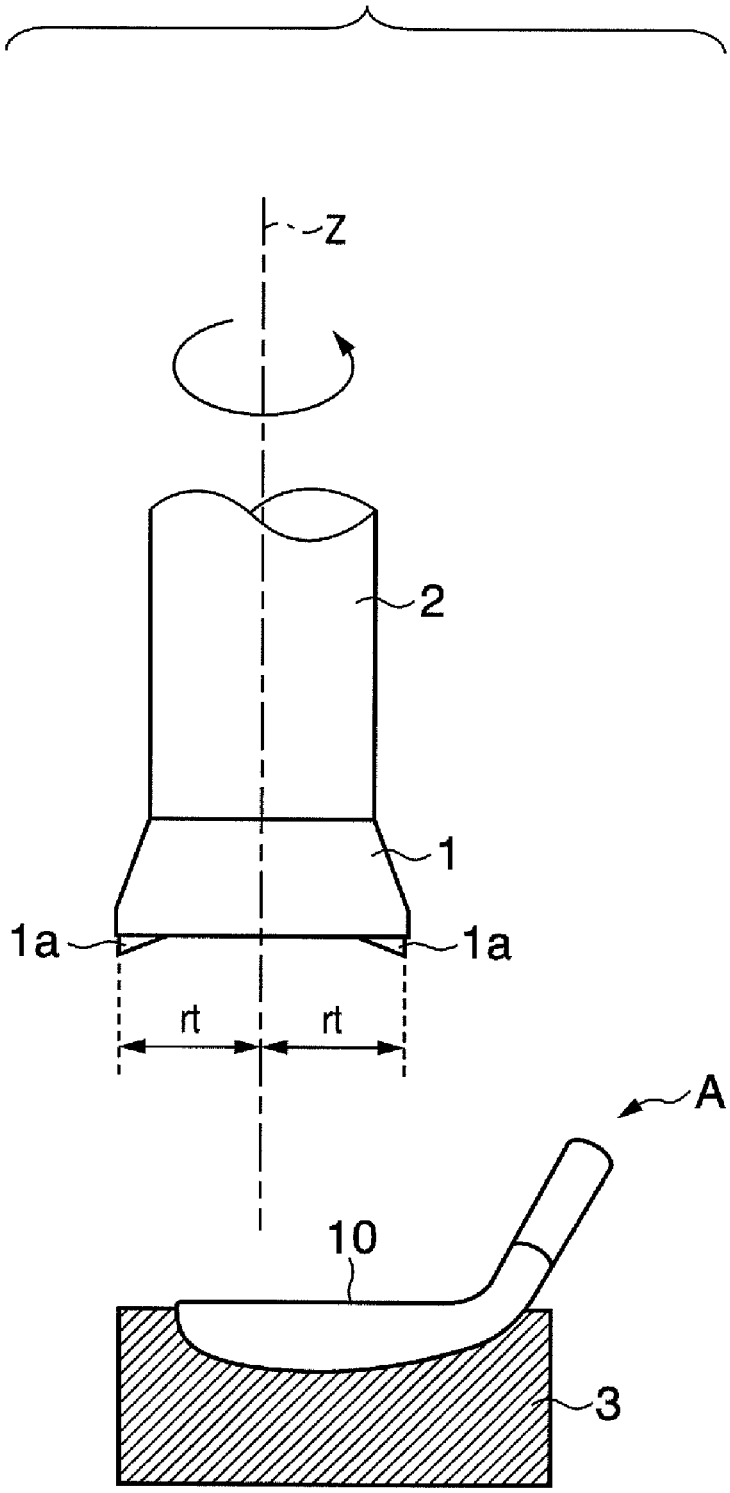
FIG. 5 is a schematic diagram illustrative of a forming method of striations 30 using a milling machine.

The milling for forming the striations 30 may be performed using a milling machine, for example. FIG. 5 is a schematic diagram illustrative of a forming method of striations 30 using a milling machine. The milling machine comprises a spindle 2 that rotates about a vertical axis Z, and a cutting tool (endmill) 1 is attached to the lower end of the spindle 2. A golf club head A, that has not been formed with the striations 30, fixed with the milling machine by way of a jig 3 so that the face 10 is horizontal. A cutting portion 1*a* of the cutting tool is separated from the vertical axis Z by a distance rt, which is the radius of the circle of arc of each striation 30.

Figure 6:
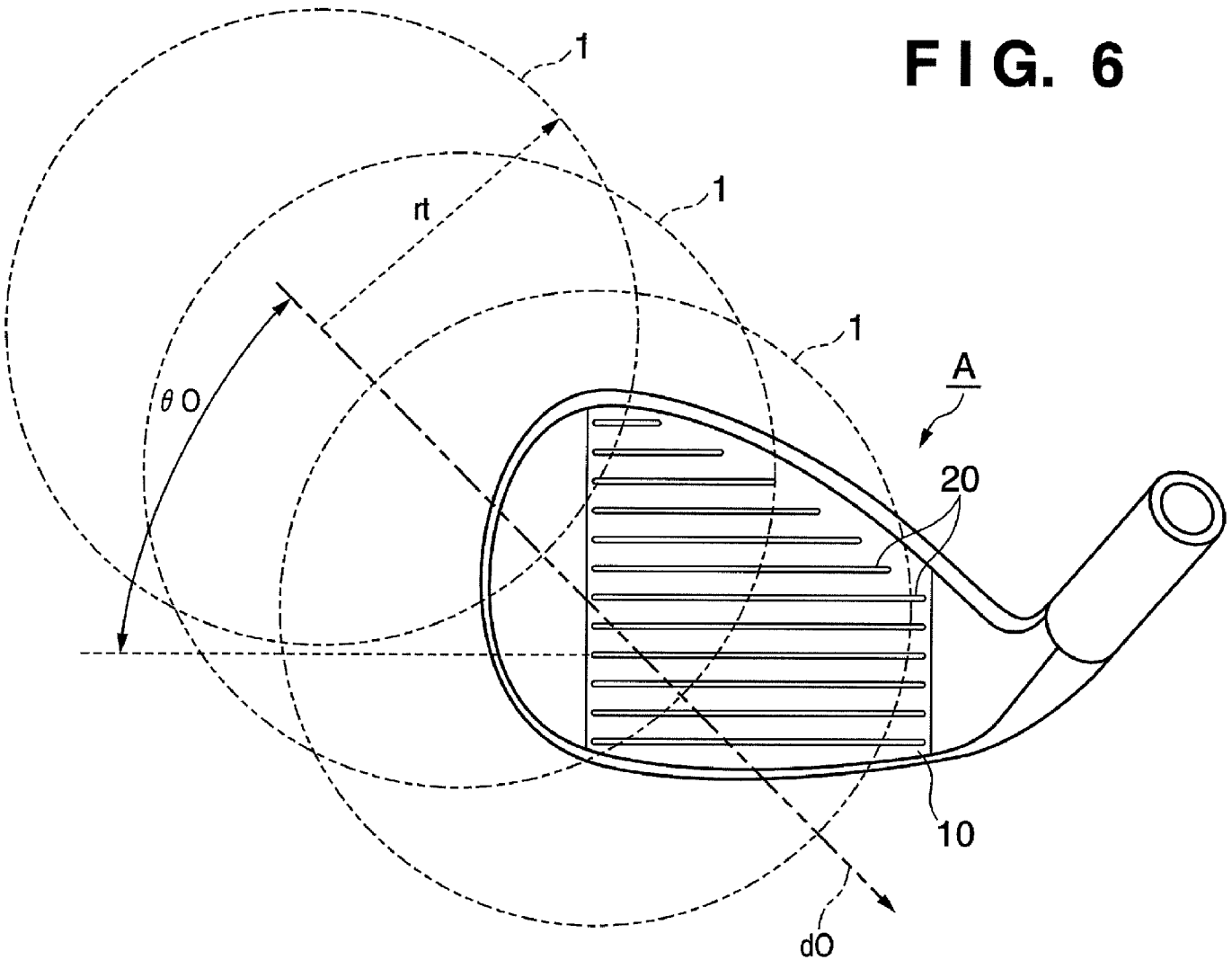
FIG. 6. is a planar view diagram illustrative of a moving path of a cutting tool 1 when milling the striations 30.

FIG. 6. is a planar view diagram illustrative of a moving path of the cutting tool 1 when milling the striations 30. The relative direction of movement, i.e., the horizontal direction, of the cutting tool 1 and the golf club head A, is identical with the arrangement direction d0 of the striations 30. As the cutting tool 1 is moved in the arrangement direction d0, relative to the golf club head A, the plurality of striations 30 is formed by milling the face 10 with the cutting tool 1. The center of the circle arc of each striation 30, or in other words, the position of the vertical axis Z, passes through the arrangement direction d0. Accordingly, the arrangement direction d0 is the direction that passes through the center of the circle arc of each striation 30. The depth, width, and pitch of each striation 30 is adjusted by the depth of the cut into the face 10 by the cutting tool 1 and the relative moving speed of the cutting tool 1.

The face 10 face is formed so as to have the arithmetic mean deviation of the profile (Ra) of not less than 4.00 μm by such milling in the embodiment. By forming the face 10 with the arithmetic mean deviation of the profile (Ra) of not less than 4.00 μm, the surface roughness of the face 10 increases compared to giving the face 10 a mirrored finish. Increased surface roughness of the face 10 improves friction between the ball and the face 10, which makes it easier to impart spin to the ball, nevertheless the ball is shot from the rough. The greater the surface roughness of the face 10, the easier it is to impart spin to the ball, and the more likely the ball is to be damaged.

Accordingly, it is preferable for the surface roughness of the portion of the face 10 that forms the striations 30 to have the arithmetic mean deviation of the profile (Ra) of between 4.00 μm and 4.57 μm, inclusive. It is also preferable for the maximum height of the profile (Ry) to be not greater than 25 μm. Keeping the surface roughness of the face 10 within the specified range of values also meets the regulations pertaining to the surface roughness of the face of a golf club head to be used in official competition golf.

The larger the angle θ1 of the score line groove 20, the less likely the ball is to be damaged, and the less spin it is likely to receive. On the other hand, the arithmetic mean deviation of the profile (Ra) of the face 10 of not less than 4.00 μm improves the amount of spin on the ball, nevertheless the ball is shot from the rough. Accordingly, having the arithmetic mean deviation of the profile (Ra) of the face 10 of not less than 4.00 μm allows increasing the angle θ1 of the score line groove 20.

In other words, adjusting the angle θ1 of the score line groove 20 and the surface roughness of the face 10 allows increasing the amount of spin on the ball, while avoiding damage thereto. According to the embodiment, the score line groove 20 also improves drainage performance of the face 10, and makes it easier to get rid of grass and dirt that may be caught between the face 10 and the ball into the score line groove 20. Accordingly, it is easier to impart spin to the ball without significantly decreasing the friction coefficient of face 10, when hitting in bad weather or in the rough. Accordingly, it is possible to reduce the difference between the amount of spin imparted to the ball when hitting in good weather or on the fairway, and the amount of spin imparted to the ball when hitting in bad weather or in the rough.

Figure 7A:
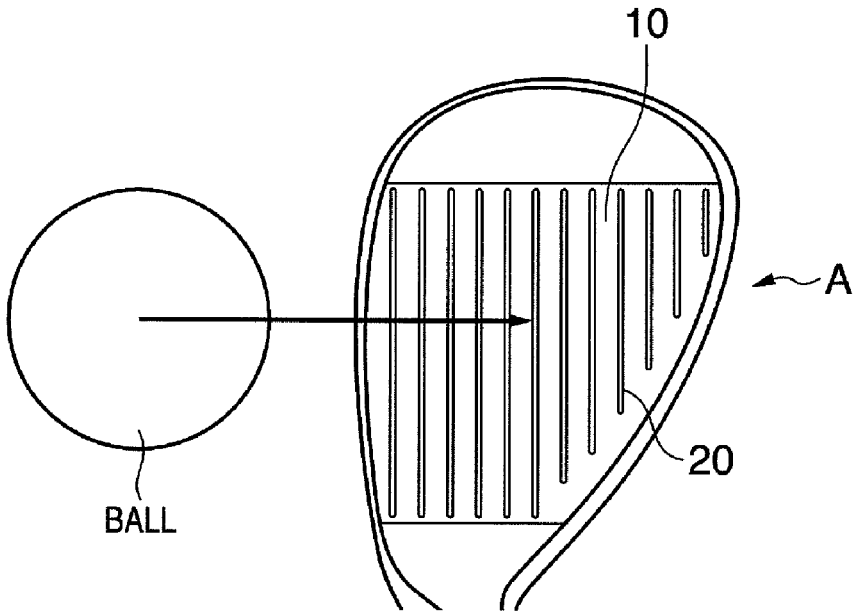
FIG. 7A depicts a face 10 when directly facing in the target direction.
Figure 7B:
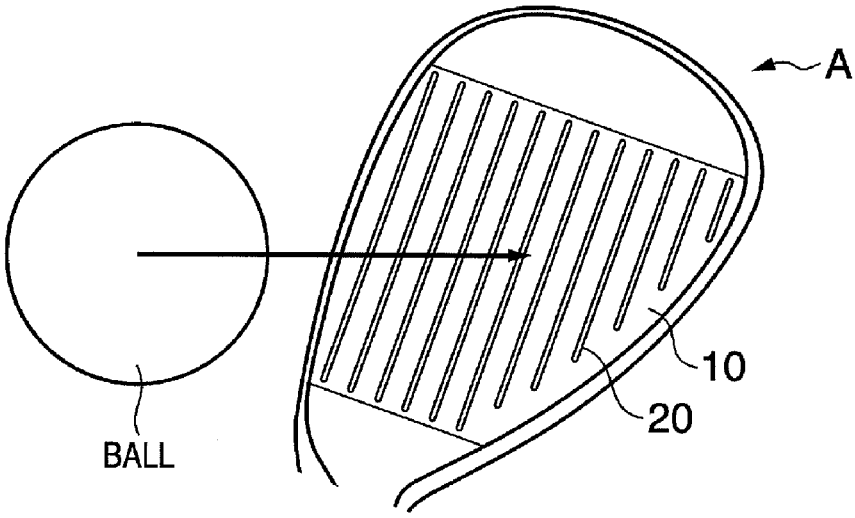
FIG. 7B depicts the face 10 when opened.

Next, in the embodiment, since the angle θ0, which is formed from the arrangement direction d0 of the plurality of striations 30 and the score line groove 20, is between 40 degrees and 70 degrees, inclusive, it becomes easier to impart spin to the ball, allowing obtaining a greater amount of spin when using a golf club with the golf club head A when the face 10 is opened, as described in FIGS. 7A and 7B.

FIG. 7A depicts a situation wherein the face 10 is facing directly in the target direction, and FIG. 7B depicts a situation wherein the face 10 is opened. The striations 30 have been omitted from FIGS. 7A and 7B. The arrows in FIGS. 7A and 7B depict the direction of relative movement of the ball vis-à-vis the face 10 at time of impact.

In the embodiment, applying the plurality of striations 30 makes it easier to impart spin to the ball in both the situation shown in FIG. 7A and FIG. 7B. If the face 10 is opened, as depicted in FIG. 7B, results in the ball rubbing against the face 10 at time of impact in such a manner as to intersect the score line grooves 20 at an angle.

Presuming the angle θ0, which is formed by the arrangement direction d0 of the plurality of the striations 30 and the score line grooves 20, to be between 40 and 70 degrees, according to the embodiment, the number of striations 30 that rub against the ball is increased when the face 10 is opened, as depicted in FIG. 7B. To put it another way, the angle of the direction of relative movement of the ball and the striations 30 approaches a right angle. Accordingly, it becomes easier to impart spin to the ball, allowing obtaining a greater amount of spin.

Figure 8:
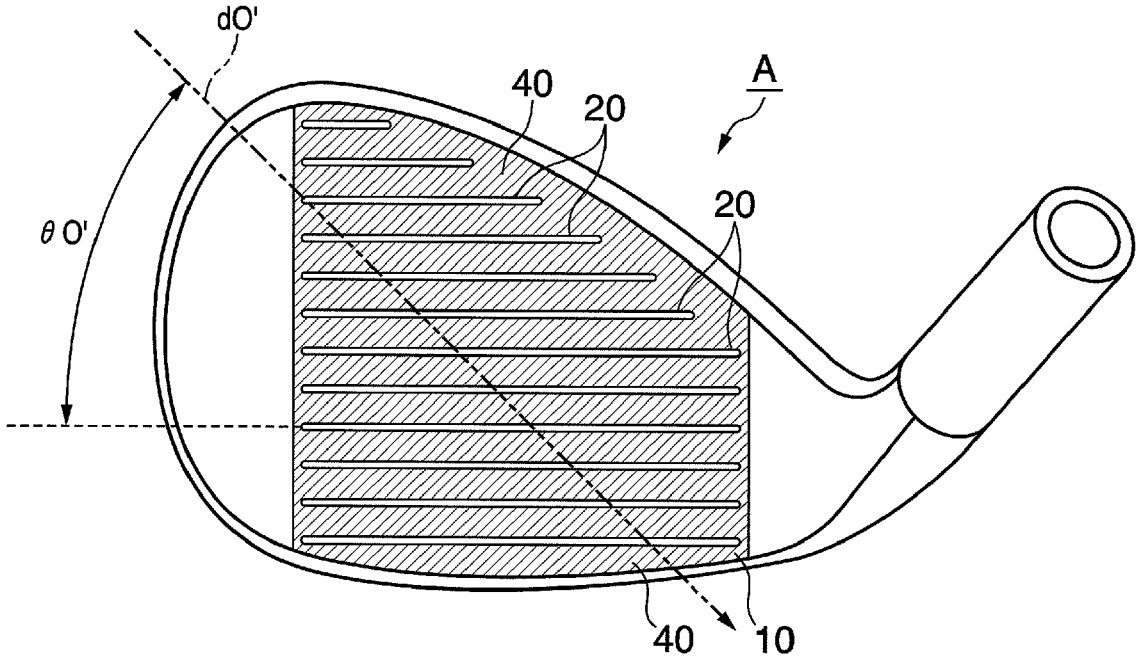
FIG. 8 depicts another example of striations.

While each striation 30 has been formed as a circular arc according to the embodiment, it is possible to form the striations 30 as a straight line as well. FIG. 8 is an external view of an example of a golf club head A with striations in a different shape. The example given in FIG. 8 is identical to the example shown in FIG. 1, except for the fact that a plurality of striations 40 shown in FIG. 8 are formed of straight lines.

The plurality of striations 40 are mutually formed in parallel. When each striation 40 is straight lines, according to the embodiment, an arrangement direction d0' is defined as a direction that is orthogonal to each striation 40. An angle θ0' formed from the arrangement direction d0' and the lengthwise direction of the score line groove 20 is between 40 and 70 degrees, inclusive, as measured clockwise from the toe side end of the score line groove 20.

Even if the striations 40 have a straight line shape, it is easier to impart spin to the ball, and it is particularly easier to impart spin to the ball when the face 10 is opened, making it easier to obtain a greater amount of spin on the ball in either case.

<Score Line Grooves Assessment Experiment>

FIG. 10 depicts the findings of an experiment that measured ball damage and spin for golf club heads No. 1 to No. 5, and golf club heads No. 11 to No. 19, each with different score line groove specifications. All of the golf club heads are sand wedges with a loft angle of 56 degrees, and milling has not been performed on their faces.

The experiment involved using golf clubs with each of the golf club heads No. 1 to No. 5, and each of the golf club heads No. 11 to No. 19 attached, to hit a heretofore never used golf ball with a robot machine. The head speed of the sand wedge was set to 40 m/s. It was also decided to hit the ball 10 times each with a dry face and with a wet face, wherein the face was covered with a thin sheet of paper that had been soaked in water, in consideration of taking shots in good weather and the fairway and in bad weather and the rough.

Figure 9A:
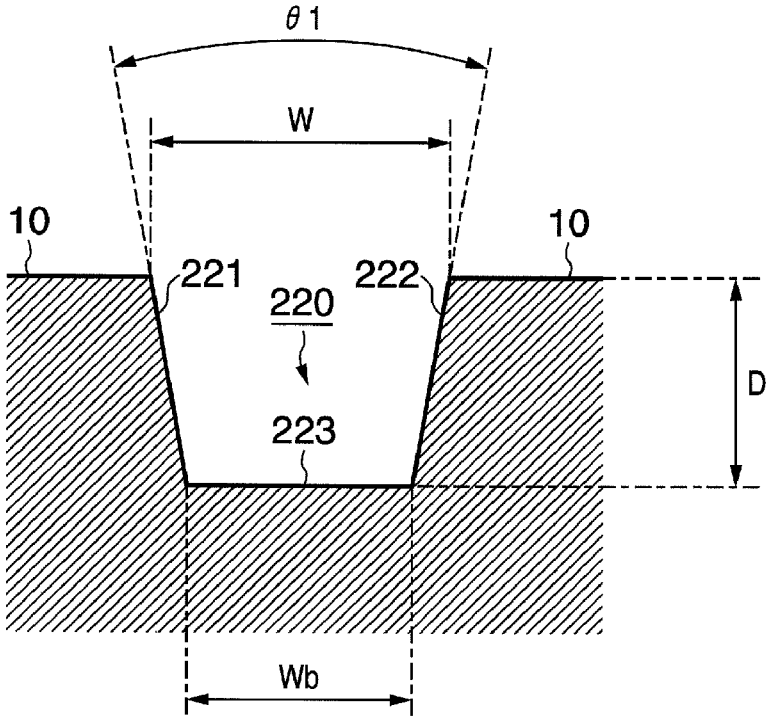
FIG. 9A and FIG. 9B are cross-sectional diagrams of score line grooves for the golf club heads No. 1 to No. 5.

The "score line groove specifications" section of FIG. 10 depicts the score line groove specifications for each of the golf club heads No. 1 to No. 5, and each of the golf club heads No. 11 to No. 19. The "Cross section shape" depicts the shape of the cross section for each of the golf club heads No. 1 to No. 5, and each of the golf club heads No. 11 to No. 19. The "single side surface (trapezoidal)" for the golf club heads No. 1 to No. 3 refers to the shape of the cross section of a score line groove 220 that is depicted in FIG. 9A. The shape of the cross section of the score line groove 220 is bilaterally symmetrical with respect to the center line. The angle θ1 is formed from the side surfaces 221 and 222, and the side surfaces 221 and 222 are unified, with angles that do not change along their surfaces. The depth D is the distance from the face 10 to a bottom surface 223, and the width W of the score line groove 220 refers to the distance between the edges of the score line groove 220.

The edges of the score line grooves of the golf club heads No. 1 to No. 5, and of the golf club heads No. 11 to No. 17 are not rounded, that is, the rounding radius r=0, and, accordingly, the width W is identical in all instances to the rule-based width Wr, which is set to 0.9 mm, as depicted in FIG. 10. The edges of the score line grooves of the golf club heads No. 18 and No. 19, on the other hand, are rounded, that is, the rounding radius r=0.2 mm, and the width W is not identical to the rule-based width Wr. The rule-based width Wr for both the golf club heads No. 18 and No. 19 is set to 0.9 mm or less, however.

Figure 9B:
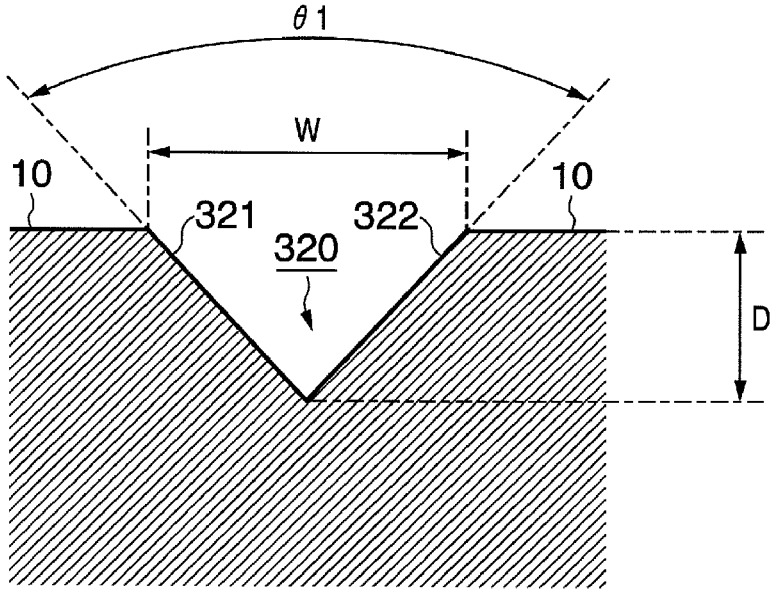

The "single surface (V-shaped)" for the golf club heads No. 4 and No. 5 refers to the shape of the cross section of a score line groove 320 that is depicted in FIG. 9B, wherein the score line groove 320 is bilaterally symmetrical with respect to the center line. The angle θ1 is formed from side surfaces 321 and 322, and the side surfaces 321 and 322 are unified, with angles that do not change along their surfaces. The depth D is the distance from the face 10 to the intersection of the side surface 321 and the side surface 322. The width W of the score line groove 320 refers to the distance between the edges of the score line groove 320.

The "two-step side surface (with bottom surface)" of the golf club heads No. 11 to No. 14, and of the golf club heads No. 16 to No. 19 refers to the shape of the cross section that is depicted in FIG. 2 and FIG. 4A. The "two-step side surface (without bottom surface) of the golf club head No. 15 refers to the shape of the cross section that is depicted in FIG. 4B. In other words, the golf club heads No. 11 to No. 19 employ either the score line grooves 20 or the score line grooves 120, according to the embodiment of the present invention.

The "angle θ1", "angle θ2", "width W", and "depth D" in FIG. 10 correspond to the symbols depicts in FIG. 2, FIG. 3, FIG. 4A, and FIG. 4B. The depth D is 0.5 mm, which is the maximum value allowed by the rules. The "cross section area S" is the cross section area for each score line groove. The "cross section area ratio" is calculated using the Equation 1. The "pitch" given in FIG. 10 is the interval between the score line grooves, which is 3.60 mm for all golf club heads aside from the golf club head No. 18.

Of the Findings, the "degree of scratches" is determined by visual and tactile examination of the level of scratches on the surface of the ball after each shot, when the face is dry, by three assessors, who rank the level of scratches on a 10-step scale. The experiment in question assigned a 10 to the ball whose surface had the most scratching, and a 1 to the ball whose surface had the least scratching. The "amount of spin" is calculated by marking the ball prior to the shot, and using a video camera to track the change in the location of the mark at time of impact. The scores shown are the average of 10 shots each for dry and wet conditions.

Figure 11A:
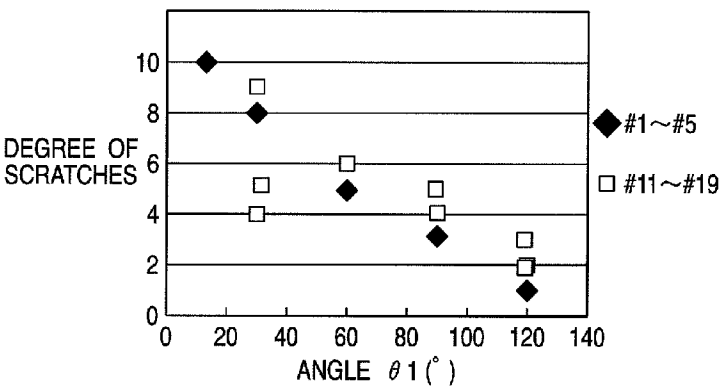
FIGS. 11A to 11C depict the findings of an experiment with the golf club heads No. 1 to No. 5, and golf club heads No. 11 to No. 19.

FIG. 11A graphs the angle θ1 versus the degree of scratches given in the Findings in FIG. 10. Low values of the Angle θ1 signify a small angle of the edge of the score line groove, while high values of the Angle θ1 signify a large angle of the edge of the score line groove. The golf club heads No. 1 to No. 5, and the golf club heads No. 11 to No. 19, show a similar trend, wherein the smaller the value of the Angle θ1, the greater the level of scratches on the surface of the ball, whereas the greater the value of the Angle θ1, the less scratches on the surface of the ball. The golf club heads No. 18 and No. 19, however, which have rounding on the edges of the score line grooves, have less scratches than the golf club heads No. 2 and No. 6, which have the same angle θ1, signifying that rounding on the edges of the score line grooves has the effect of avoiding damage to the ball.

A degree of scratches of eight or more signifies a level of scratches on the surface of the ball that would make it difficult, for all practical purposes, to use the ball for a number of holes in a row. Accordingly, an Angle θ1 of not less than 50 degrees is preferable when the edges of the score line grooves are not rounded.

Figure 11B:
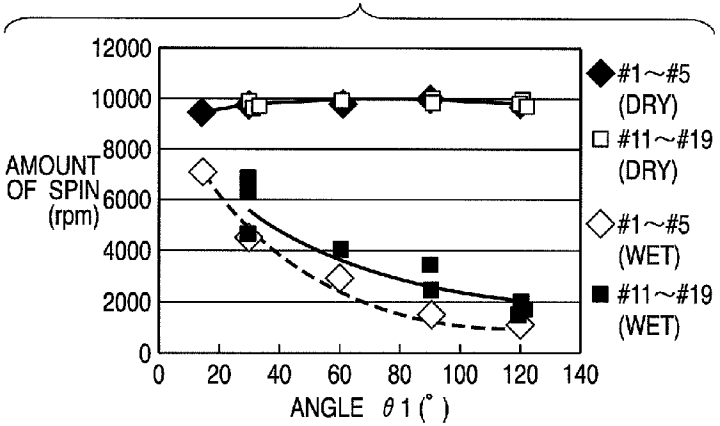

FIG. 11B graphs the relation between the Angle θ1 and the Amount of spin, for both dry and wet circumstances, given in the Findings in FIG. 10. When the face is dry, The golf club heads No. 1 to No. 5, and the golf club heads No. 11 to No. 19, show a similar trend. The findings show no significant change in amount of spin versus the angle θ1, when the face is dry. While a change in amount of spin versus the Angle θ1 is detectable when the face is wet, the overall trend is that the golf club heads No. 11 to No. 19 show a lesser decline in the amount of spin than do the golf club heads No. 1 to No. 5.

The golf club head No. 12, whose angle θ1 is 60 degrees, and the golf club head No. 14, whose angle θ1 is 90 degrees, have lowered degradation in amount of spin than the golf club heads No. 3 and No. 4, whose angles θ1 are also 60 degrees and 90 degrees, respectively. It is deduced that the difference in the cross section area S also has an effect. In other words, the golf club heads No. 11 to No. 19, with a two-step surface, have a larger cross section area, when the angle θ1 is the same, and thus, it is conceivable that it increases the amount of water into the score line grooves, which may reduce the amount of spin that would be lost. The difference between the golf club heads No. 1 to No. 5, and the golf club heads No. 11 to No. 19, on the other hand, becomes insignificant as the angle θ1 exceeds 100 degrees. Accordingly, it is desirable to have an angle θ1 of not greater than 100 degrees when using a two-step surface, as with the golf club heads No. 11 to No. 19.

The golf club heads No. 2, No. 11, No. 18, and No. 19, all with a common angle θ1 of 30 degrees, experience a small decline in amount of spin under wet conditions. The golf club head No. 18 has the least decline in amount of spin among the four golf club heads, and it is conceivable that the fact that the golf club head No. 18 has a smaller pitch of the score line grooves than the golf club heads No. 2, No. 11, and No. 19 may have an effect. The golf club head No. 19 has the next lowest decline in amount of spin among the four golf club heads, and it is conceivable that the fact that it has a larger width W than the golf club heads No. 2 and No. 11 may have an effect.

Figure 11C:
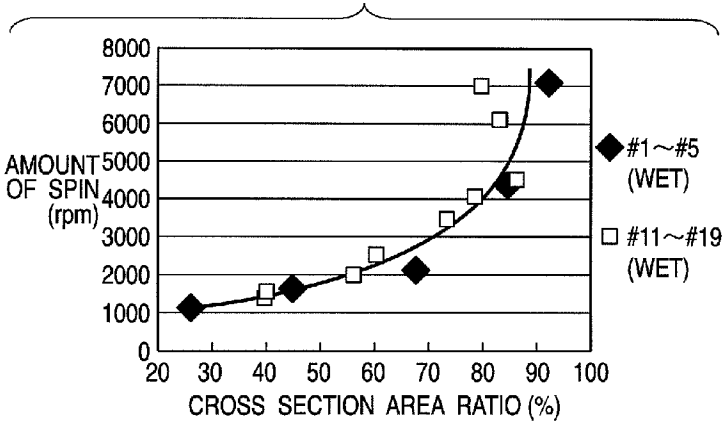

FIG. 11C graphs the relation between the cross section area ratio and the amount of spin, for the wet circumstance, given in the Findings in FIG. 10. The golf club heads No. 1 to No. 5, and the golf club heads No. 11 to No. 19, show a similar trend, in that the amount of spin for the wet circumstance correlates with the cross section area ratio. One may see that the plot becomes increasingly steep, and the amount of spin for the wet circumstance starts to increase, around the point where the cross section area ratio exceeds 70%. The plot becomes steeper still around the point where the cross section area ratio exceeds 80%. Accordingly, it is desirable to have a cross section area ratio of not less than 70%, and particularly preferable that the cross section area ratio be not less than 80%, with two-step side such as with the golf club heads No. 11 to No. 19.

Achieving a cross section area ratio of 80% or more with two-step side surfaces such as with the golf club heads No. 11 to No. 19 becomes increasingly difficult in score line groove design terms when the angle θ1 exceeds 50 degrees. Accordingly, it is preferable that the angle θ1 not exceed 50 degrees when the cross section area ratio is 80% or more. With regard to damage to the ball, it is desirable in such instance that the edges of the score line grooves be rounded, and furthermore, that the angle θ1 be not less than 10 degrees.

Based on the experimental findings, with regard to the score line groove 20 that is depicted in FIG. 2, it is preferable that the angle θ1 be between 50 and 100 degrees, inclusive, and that the cross section area ratio be not less than 70%, if the edges of the score line groove 20 are not rounded. Setting the angle θ2 to a maximum of 30 degrees will make a cross section area ratio of not less than 70% easier to achieve from a design standpoint, and accordingly, it is preferable to set the angle θ2 to a maximum of 30 degrees.

On the other hand, while a cross section area ratio of not less than 80% avoids further degradation in amount of spin in the wet circumstance, it is preferable that the angle θ1 be between 10 and 50 degrees, inclusive, and that the edges of the score line grooves 20 be rounded. Setting the angle θ2 to a maximum of 30 degrees will make a cross section area ratio of not less than 80% easier to achieve from a design standpoint, and accordingly, it is preferable to set the angle θ2 to a maximum of 30 degrees, and furthermore, that the angle θ2 be not more than 15 degrees.

Pursuant to the experimental findings, the score line groove specification was configured to make the rule-based width Wr a maximum of 0.9 mm. When using the golf club head that is the present invention in official competition golf, it is necessary that the rule-based width Wr be not larger than 0.9 mm. Making the rule-based width Wr excessively narrow, however, also narrows the score line grooves cross section area. Accordingly, it is preferable that the rule-based width Wr of the score line grooves of the golf club head that is the present invention be between 0.6 mm and 0.9 mm, inclusive.

<Striation Assessment Experiment>

FIG. 12 depicts the findings of an experiment that measured amount of spin on the ball for golf club heads No. 21, No. 22, and No. 31 to No. 37, each with different striation specifications. All of the golf club heads, No. 21, No. 22, and No. 31 to No. 37, are sand wedges with a loft angle of 56 degrees, and the circular arc striations 30 depicted in FIG. 1 have been formed in their faces by milling. All of the golf club head have common score line groove specifications and the cross-sectional shapes of the score line grooves are trapezoidal.

A cutting tool with radius (rt in FIG. 5) of 37.5 mm was used in milling the striations 30 for all of the golf club heads, No. 21, No. 22, and No. 31 to No. 37.

The "θ0" in FIG. 12 is the θ0 depicted in FIG. 1, an angle formed by an arrangement direction of the striations 30, i.e., the d0 in FIG. 1, and the score line groove. The "Ra" is actual measured value of the arithmetic mean deviation of the profile on the face in which the striations are formed.

The "amount of spin" in FIG. 12 depicts the amount of spin on the ball. The amount of Spin is calculated by marking the ball prior to the shot, and using a video camera to track the change in the location of the mark at time of impact.

The experiment involved using golf clubs with each of the golf club heads No. 21, No. 22, and No. 31 to No. 37 attached, and having three testers hit a golf ball out of the rough, aiming at a target 40 yards away. The three testers hit five balls with the face in direct line with the target direction, and five balls with the face opened. The angle at which the face was opened was left up to the testers' discretion.

The "normal", under the amount of spin heading in FIG. 12, is the average value of the amount of spin when the face is in direct line with the target direction, and the "open" is the average value of the amount of spin when the face is opened.

Figure 13A:
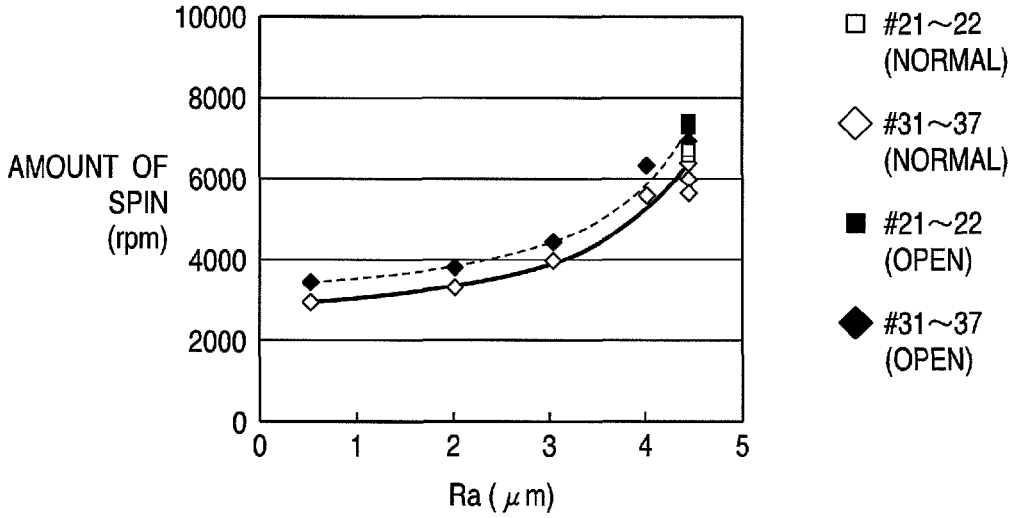
FIG. 13A graphs the relationship between the spin and the Ra findings in the experiment depicted in FIG. 12.

FIG. 13A graphs the relationship between the amount of spin and the Ra experimental findings depicted in FIG. 12. It is apparent that the rougher the face, the more spin on the ball, for both the normal and the open circumstance. The slope of the plot becomes steeper near the point where Ra reaches 4 μm, which suggests that the Ra of not less than 4 μm is preferable. Taking into account such factors as the fact that the rougher the face, the easier it is to damage the ball, as well as regulations pertaining to the surface roughness of the face on golf club heads that are used in official competition play, suggests that the arithmetic mean deviation of the profile Ra on the face of between 4.00 μm and 4.57 μm, inclusive, is preferable.

Figure 13B:
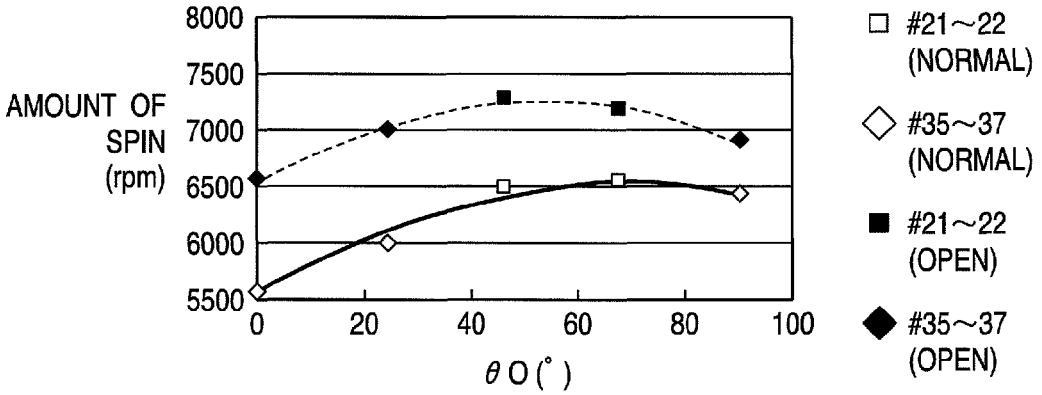
FIG. 13B graphs the relationship between the spin and the θ0 findings in the experiment depicted in FIG. 12.

FIG. 13B graphs the relationship between the amount of spin and the θ0 experimental findings depicted in FIG. 12 for the golf club heads No. 21, No. 22, and No. 35 to No. 37, all of which have identical surface roughness on the face, i.e., Ra: 4.4 μm.

It is apparent that the amount of spin increases as the θ0 ranges from 0 to the vicinity of 55 degrees, and then declines as the θ0 exceeds 55 degrees, for both the normal and the open circumstance. For the range of θ0 between approximately 30 and 80 degrees, centering on the vicinity of 55 degrees, an amount of spin of 7000 rpm or more may be obtained in the open circumstance, which suggests that a sufficient amount of spin may be obtained in the open circumstance when the θ0 is between 40 and 70 degrees, inclusive.

EXAMPLE

An experiment was performed to evaluate amount of spin on the ball in comparative examples, as well as the example of the present invention. FIG. 14A depicts the specification of the example of the present invention and comparative examples 1 to 3, and FIG. 14B depicts the findings of the experiment performed on the specification of the example of the present invention and the comparative examples 1 to 3. The example of the present invention and the comparative examples 1 to 3 are all sand wedges with a loft angle of 56 degrees.

The meanings of the respective items listed under the "score line groove specifications" heading in FIG. 14A are the same as the meanings for the respective items in FIG. 10. The cross-sectional shape of the score line groove in the example and the comparative example 3 are the cross-sectional shapes depicted in FIGS. 2 and 4A. The cross-sectional shapes of the score line grooves in the comparative example 1 and the comparative example 3 are the cross-sectional shapes depicted in FIG. 9A.

The "milling" in FIG. 14A refers to the presence or absence of milling of a face. The example and the comparative example 2 have had their faces subjected to circular arc striation 30 milling as depicted in FIG. 1. An cutting tool with radius (rt in FIG. 5) of 37.5 mm was used in milling the striations 30. The comparative example 1 and the comparative example 3 have not had their faces subjected to milling. The "Ra" in FIG. 14A actual measured value of the arithmetic mean deviation of the profile on the face in which the striations are formed.

In summary, while the comparative example 1 and the comparative example 2 have common score line groove specifications, they differ with regard to the surface roughness on the face. While the comparative example 3 and the example have common score line groove specifications, they differ with regard to the surface roughness on the face. While the comparative example 2 and the example have the same surface roughness on the face, they differ with regard to the score line groove specifications.

The experiment involved using golf clubs with each of the golf club heads in the example and the comparative examples 1 to 3 attached, and having three testers hit a golf ball out of the rough, aiming at a target 40 yards away. The three testers hit five balls from the fairway, and five balls from the rough.

In FIG. 14B, the degree of scratches is determined by visual and tactile examination of the level of scratches on the surface of the ball after each shot from the fairway, by the three testers, who rank the level of scratches on a four-step scale. Damage to the ball is ranked from most to least in the order of X→Δ→○→◎.

In FIG. 14B, the "amount of spin" depicts the amount of spin on the ball. The amount of Spin is calculated by marking the ball prior to the shot, and using a video camera to track the change in the location of the mark at time of impact. Under the amount of spin heading in FIG. 14B, the subheading "fairway" lists the average amount of spin values for the balls hit from the fairway, and the subheading "rough" lists the average amount of spin values for the balls hit from the rough.

Turning to the degree of scratches, the comparative example 3 and the example had low levels of scratches on the surface of the ball, whereas the comparative example 1 and the comparative example 2 had high levels of scratches on the ball. It is conceivable that the resulting degree of scratches to the ball is a consequence of the score line groove specifications. As depicted in FIG. 14A, the angle θ1 of the comparative example 1 and the comparative example 2 is smaller than the comparative example 3 and the example, and has edged score line grooves. In addition, the score line grooves of the comparative example 3 and the example have rounding on the edges, with a radius 0.2 mm, whereas the score line grooves of the comparative example 1 and the comparative example 2 do not have rounding on the edges.

In a comparison of the comparative example 1 and the comparative example 2, the comparative example 2 has the higher degree of scratches, whereas in a comparison of the embodiment and the comparative example 3, the embodiment has the higher degree of scratches. It is conceivable that the resulting degree of scratches to the ball is a consequence of the milling.

Figure 15:
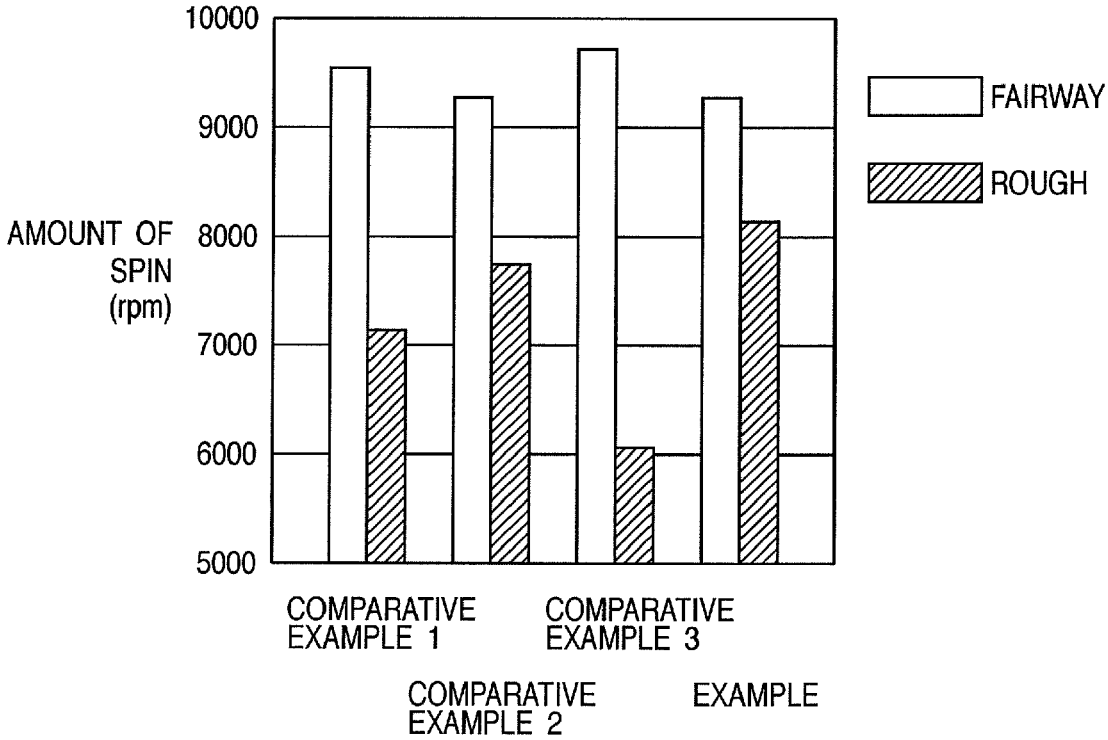
FIG. 15 graphs the spin from the findings of the experiment in FIG. 14B.

Turning the amount of spin, FIG. 15 graphs the amount of spin from the findings of the experiment in FIG. 14B. There is no significant difference in the shots from the fairway with the example and the comparative examples 1 to 3. There is a difference in the shots from the rough, however.

Of the example and the comparative examples 1 to 3, it is apparent that the example shows the smallest difference between the shots from the fairway and the shots from the rough. While the comparative example 3 and the example have common score line groove specifications, a significant difference emerges in the amount of spin with the shots from the rough, suggesting, accordingly, that the presence or absence of the milling has an effect thereupon.

With an overall assessment of the degree of scratches and the amount of spin, the comparative example 1 and the comparative example 2 are inferior to the comparative example 3 and the example with regard to the degree of scratches. While the comparative example 3 fared best with regard to the degree of scratches, it also experienced significant degradation in amount of spin with the shots from the rough, suggesting, accordingly, that the example is the best of all.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A golf club head, comprising:

a face;

a plurality of score line grooves formed in said face, each score line groove including a pair of side surfaces; and traces formed in said face by milling, wherein each of said side surface includes a first surface at a face side of said score line groove and a second surface at a bottom side of said score line groove, wherein a first angle that is formed between each first surface of the pair of side surfaces is larger than a second angle that is formed between each second surface of the pair of side surfaces, wherein an arithmetic mean deviation of a profile of said face in which said traces are formed is not less than 4.00 μm, wherein said traces are a plurality of striations which do not intersect with each other on said face, and wherein an angle formed by an arrangement direction of the plurality of striations and said score line groove is between 40 degrees and 70 degrees, inclusive, as viewed clockwise from a toe side end of said score line groove.

2. The golf club head according to claim 1, wherein each striation forms a circular arc, and wherein the arrangement direction is a direction that intersects the center of the circular arc of each striation,

3. The golf club head according to claim 2, wherein said striations are the only circular arcs on said face.

* * * * *